US007182614B2

(12) United States Patent
Crestin

(10) Patent No.: US 7,182,614 B2
(45) Date of Patent: Feb. 27, 2007

(54) ELECTRICAL CONTACT WITH ELASTIC RETURN AND ELECTRICAL CONNECTION ELEMENT EQUIPPED WITH THE SAME

(75) Inventor: Joseph Crestin, Vanves (FR)

(73) Assignee: Societe d'Exploitation des Procedes Marechal (SEPM), Saint-Maurice Cedex (FR)

( * ) Notice: Subject to any disclaimer, the term of this patent is extended or adjusted under 35 U.S.C. 154(b) by 0 days.

(21) Appl. No.: 11/036,982

(22) Filed: Jan. 19, 2005

(65) Prior Publication Data

US 2005/0130475 A1 Jun. 16, 2005

Related U.S. Application Data

(63) Continuation of application No. PCT/FR2003/003582, filed on Dec. 4, 2003.

(30) Foreign Application Priority Data

Dec. 6, 2002 (FR) ..... 02 15435

(51) Int. Cl.
*H01R 29/00* (2006.01)

(52) U.S. Cl. ..... 439/188; 439/289; 439/700

(58) Field of Classification Search ..... 439/188, 439/289, 578, 700; 200/51.1
See application file for complete search history.

(56) References Cited

U.S. PATENT DOCUMENTS 4,778,404 A 10/1988 Pass
4,941,846 A * 7/1990 Guimond et al. ..... 439/578
5,015,194 A * 5/1991 Seas ..... 439/314
5,052,484 A 10/1991 Gesta
5,417,595 A * 5/1995 Cullen et al. ..... 439/700
5,529,522 A * 6/1996 Huang ..... 439/460
5,591,039 A * 1/1997 Matthews ..... 439/181
5,667,410 A * 9/1997 Johnston ..... 439/700
6,139,344 A * 10/2000 Wang ..... 439/188
6,396,367 B1 * 5/2002 Rosenberger ..... 333/260
6,398,592 B1 * 6/2002 Mori et al. ..... 439/700
6,406,313 B1 * 6/2002 Victor ..... 439/175
6,491,968 B1 * 12/2002 Mathieu et al. ..... 29/842
6,517,379 B2 * 2/2003 Leve ..... 439/578
6,619,876 B2 * 9/2003 Vaitkus et al. ..... 403/349
6,758,577 B2 * 7/2004 Wu ..... 362/647
6,863,576 B2 * 3/2005 Campbell et al. ..... 439/700

FOREIGN PATENT DOCUMENTS

DE 8806966 6/1989
EP 0643444 3/1995

* cited by examiner

*Primary Examiner*—Thanh-Tam Le
(74) *Attorney, Agent, or Firm*—Greenblum & Bernstein, P.L.C.

(57) ABSTRACT

Electrical contact with elastic return and process for forming electrical contact with elastic return. Electrical contact includes a conductive part having a front surface structured and arranged to face an open end. The conductive part has a cut arranged to form at least one flexible blade from the front surface of a conductive part. The instant abstract is neither intended to define the invention disclosed in this specification nor intended to limit the scope of the invention in any way.

34 Claims, 4 Drawing Sheets

ELECTRICAL CONTACT WITH ELASTIC RETURN AND ELECTRICAL CONNECTION ELEMENT EQUIPPED WITH THE SAME

CROSS-REFERENCE TO RELATED APPLICATIONS

The present application is a Continuation of International Patent Application No. PCT/FR2003/003582 filed Dec. 4, 2003, and claims priority of French Patent Application No. 02/15435 filed Dec. 6, 2002. Moreover, the disclosure of International Patent Application No. PCT/FR2003/003582 is expressly incorporated by reference herein in its entirety.

BACKGROUND OF THE INVENTION

1. Field of the Invention

The invention relates to an electrical contact with elastic return and to an electrical connection element provided with at least one such contact.

2. Discussion of Background Information

Electrical contacts with elastic return, in particular for end-on contact pressure, are well known.

In one embodiment, they comprise a contact head which comes into elastic engagement with an opposing contact under the action of a helical spring that surrounds a deformable conductor such as a braid, which conductor is connected to a cable, optionally via a connection terminal or lug.

In addition to the problems inherent to repeatedly deforming the deformable conductor, those known contacts are of significant length, and they lead to additional resistance due to the crimping zones between the various parts.

For certain applications, proposals have been made to hold a contact head stationary at the end of a cable by means of a spring-forming blade, e.g. as disclosed in document EP-0 643 444 in the name of the same Applicant.

Nevertheless, under those circumstances, the elastic movement cannot be performed along the general longitudinal axis of the conductor.

SUMMARY OF THE INVENTION

The invention provides a simple electrical contact with elastic return making it possible in particular to establish a connection with end-on contact pressure for a variety of applications as described below. In addition, the invention makes it possible in particular to reduce the size of the contact and to eliminate and reduce certain amounts of electrical resistance.

To this end, the invention provides an electrical contact with elastic return that is remarkable in particular in that it includes at least one flexible blade constituted by a portion of the front surface of a conductive part that is provided with at least one cut formed at its end. The blade is thus capable of flexing under the action of the pressure exerted by an opposing electrical contact.

In an embodiment, the conductive part is cylindrical, and the flexible blade is in the form of a circular or elliptical segment or zone, in which case, for a contact including a single blade and a single cut, the depth of the cut is greater than the radius of the cylindrical part. By way of optional example, the cut in the conductive part lies in a plane perpendicular to the longitudinal axis of said part. Preferably, the width of the cut is no greater than the maximum acceptable deflection for the flexible blade prior to reaching its elastic limit, which maximum deflection is a function of the nature of the materials used and the depth of the cut, so that the blade cannot exceed its elastic limit.

In an embodiment, a compression spring is arranged behind the blade bearing against the end of a housing provided for this purpose in the conductive part so as to contribute to returning the blade into an initial position.

Preferably, the flexible blade is also provided over at least a portion of its surface with a pellet of silver for improving the passage of electric current between said contact and the opposing electrical contact.

The contact of the invention is for fitting to numerous appliances which also form part of the invention, such as, for example, a single-pole electrical connection element in the form of a socket-outlet or a connector, provided with an electrical contact of the invention including at least one flexible blade, designed to establish an electrical connection with an opposing electrical contact to be coupled thereto, and in the form of a pin of a plug or of an appliance inlet, said pin exerting pressure on the blade in a direction parallel to the axis of the conductive part.

In which case, for example, the conductor part of the electrical contact is provided with a thread which terminates in the vicinity of its cut and which is designed to co-operate with a screw ring formed on the plug or the appliance inlet in order to secure it to said connection element in the coupled position.

The present invention is directed to an electrical contact with elastic return. The electrical contact includes at least one flexible blade formed by a portion of a front surface of a conductive part provided at its end with at least one cut. The at least one blade is structured and arranged to flex under pressure exerted by an opposing electrical contact.

In accordance with a feature of the invention, the conductive part can be cylindrical, and the at least one flexible blade may include one of a circular or elliptical segment.

According to another feature, the at least one blade can include a single blade and the at least one cut may be a single cut having a depth greater than a radius of the cylindrical part.

According to still another feature of the instant invention, the at least one cut may lie in a plane perpendicular to a longitudinal axis of the conductive part.

Further, a width of the at least one cut can be no greater than a maximum acceptable deflection for the flexible blade prior to it reaching its elastic limit. The maximum deflection can be a function of materials used and depth of the at least one cut.

In accordance with a further feature of the present invention, a compression spring may be arranged behind the at least one blade and may be positioned to bear against an end of a housing located in the conductive part. The compression spring can be positioned to contribute to returning the at least one blade to an initial position.

According to a still further feature of the invention, a pellet of silver may be provided over at least a portion of the at least one flexible blade.

Moreover, a material can be provided over at least a portion of the at least one flexible blade to improve passage of electric current between the contact and the opposing electrical contact.

The instant invention is directed to a single-pole electrical connection element having an electrical contact, as discussed above, and an opposing electrical contact structured and arranged to exert pressure on the at least one flexible blade in a direction parallel to an axis of the conductive part.

According to the present invention, the opposing electrical contact can be composed of a pin, and the pin may be located in one of a plug or an appliance inlet. Further, the single-pole electrical connection element can include one of a socket-outlet or a connector.

In accordance with another feature, the conductor part can have a threaded portion and the one of a plug or an appliance inlet may include a screw ring structured and arranged to secure to the threaded portion of the conductor part. The threaded portion can terminate in a vicinity of the at least one cut.

The present invention is directed to an electrical contact with elastic return including a conductive part having a front surface structured and arranged to face an open end. The conductive part has a cut arranged to form at least one flexible blade from the front surface of a conductive part.

According to a feature of the invention, an insulating layer can be arranged between the front surface and the open end, such that the insulating layer has an opening open to the front surface.

In accordance with another feature, a may be housing formed in the conductive part, and a compression spring can be located within the housing arranged to contact a surface of the front surface adjacent the cut.

According to the invention, an electrical plug is structured for coupling to the above-discussed electrical contact, in which the electrical plug includes an electrical contact structured and arranged to pass through the opening and to contact the front surface. Moreover, a screw ring is couplable to the conductive part, such that the electrical contact is structured and arranged to exert pressure on front face when the screw ring is secured to the conductive part.

The present invention is directed to a process of forming an electrical contact with elastic return. The process includes cutting an end of a conductive part to form at least one flexible blade from a front surface of the conductive.

In accordance with still yet another feature of the present invention, the process can further include forming a housing in the conductive part adjacent the cut and positioning a compression spring in the housing to bias the at least one flexible blade away from the housing. The process can also include placing insulation over the at least one flexible blade, such that the insulation includes an opening open to the at least one flexible blade.

BRIEF DESCRIPTION OF THE DRAWINGS

The invention will be better understood and other features will appear on reading the following description which refers to the accompanying drawings, in which.

DETAILED DESCRIPTION OF THE PRESENT INVENTION

Figure 1:
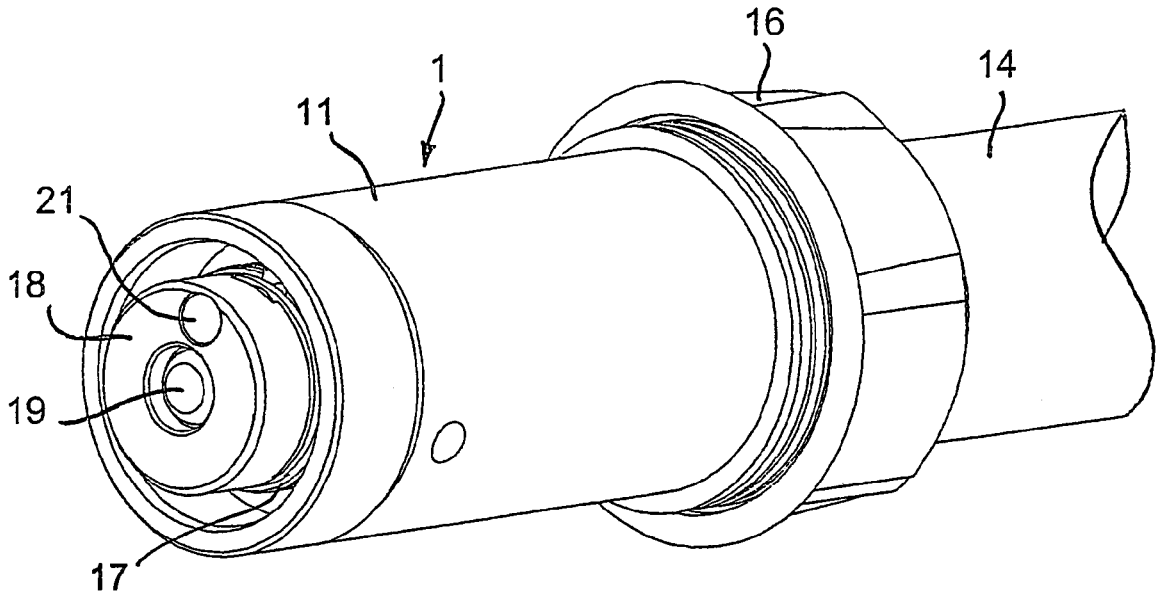
FIGS. 1 and 2 are perspective views respectively of a connector in accordance with the invention and of a plug for coupling with the connector to form a cable coupler.

In the drawings, there can be seen by way of example a single-pole cable coupler made up of a connector 1 and a plug 2 (FIGS. 1 to 5).

Figure 5:
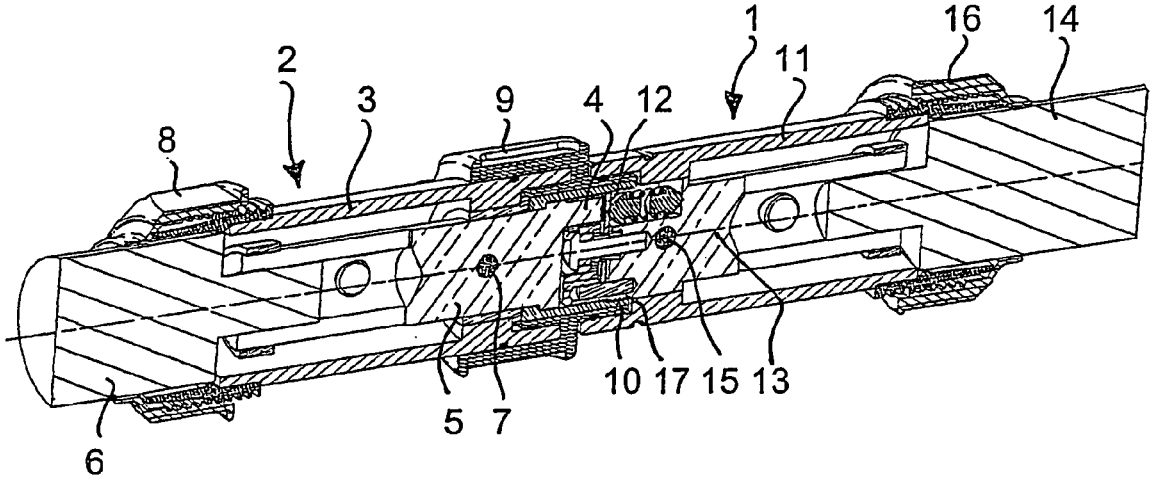
FIG. 5 is an axial section showing the connector and the plug of FIGS. 1 to 4 connected together to form a cable coupler.

Plug 2 is designed to couple with connector 1 by taking up the connection position shown in section in FIG. 5.

Figure 4:
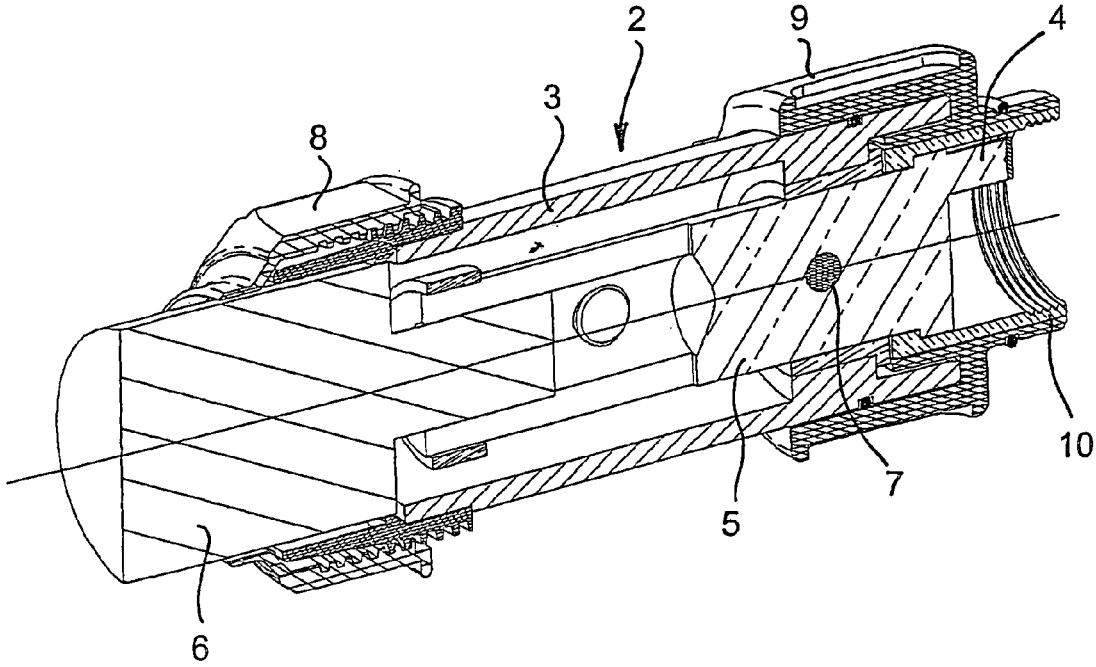

Plug 2 comprises an insulating case 3 in which there is arranged a contact pin 4 (FIGS. 2, 4, 5, 6, and 7) secured to a cylindrical metal part 5, itself connected to a cable 6 by screw fastening, crimping, or other engagement. By way of example, part 5 is held in case 3 by a dowel 7 (FIGS. 4 and 5).

In the embodiment shown, pin 4 is off-center, but it could be less off-center or not off-center at all depending on its nature and/or the disposition of the contact of the connector described below.

In this case, cable 6 is also held by a cable clamp 8, while a clamping ring 9 is provided to turn a partially-tapped screw ring 10, described in greater detail below, and serving, when actuated, to lock the coupling between plug 2 and connector 1, screw ring 10 being advantageously made out of metal, and clamping ring 9 out of insulating material.

In similar manner to plug 2, connector 1 includes an insulating case 11 in which there is provided a contact in the form of a flexible blade 12 secured to a metal part 13, in this case a cylindrical part, which is connected to a cable 14 by screw fastening, crimping, or other engagement. By way of example, part 13 is held in case 11 by a dowel 15.

In the example shown, cables 6 and 14 are connected to the corresponding metal parts 5 and 13 respectively by screw fastening, but another known and advantageous method of fastening consists in crimping them by tubes, thus making it easy to obtain a plurality of sizes using the same parts.

Cable 14 is also held in this case by a cable clamp 16, and part 13 is provided at its end with a thread 17 for co-operating with screw ring 10 of plug 2.

Figure 3:
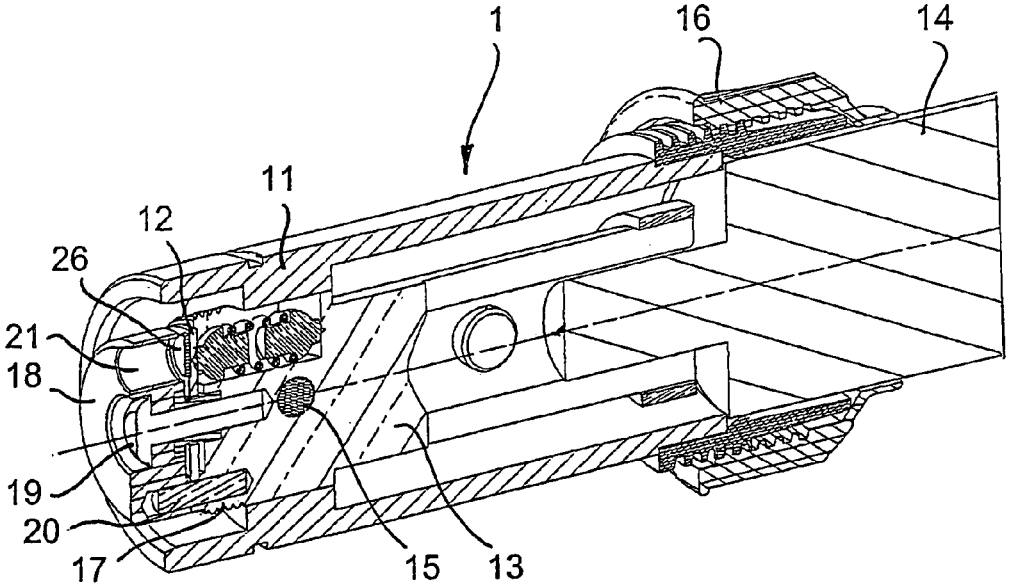
FIGS. 3 and 4 are axial sections respectively of the connector and of the plug of FIGS. 1 and 2.

As shown clearly in the figures, the end of metal part 13 of connector 1 is protected at its front end by insulation 18 secured to part 13, e.g. by a central screw 19 (FIGS. 1 and 3), and it is prevented from turning by an off-center peg 20 (FIG. 3).

A circular opening 21 (FIGS. 1 and 3) is provided in insulation 18, which opening is off-center in this example and is designed to pass pin 4 of plug 2 so that the end of pin 4 can press against blade 12 of connector 1, as described in greater detail below. To couple plug 2 and connector 1, it suffices to cause pin 4 of plug 2 to penetrate into opening 21 of connector 1 and to screw ring 10 of plug 2 onto thread 17 of part 13 by turning clamping ring 9 of plug 2. This provides a mechanically strong coupling because metal ring 10 is screwed onto part 13 which is likewise made of metal.

Figure 6:
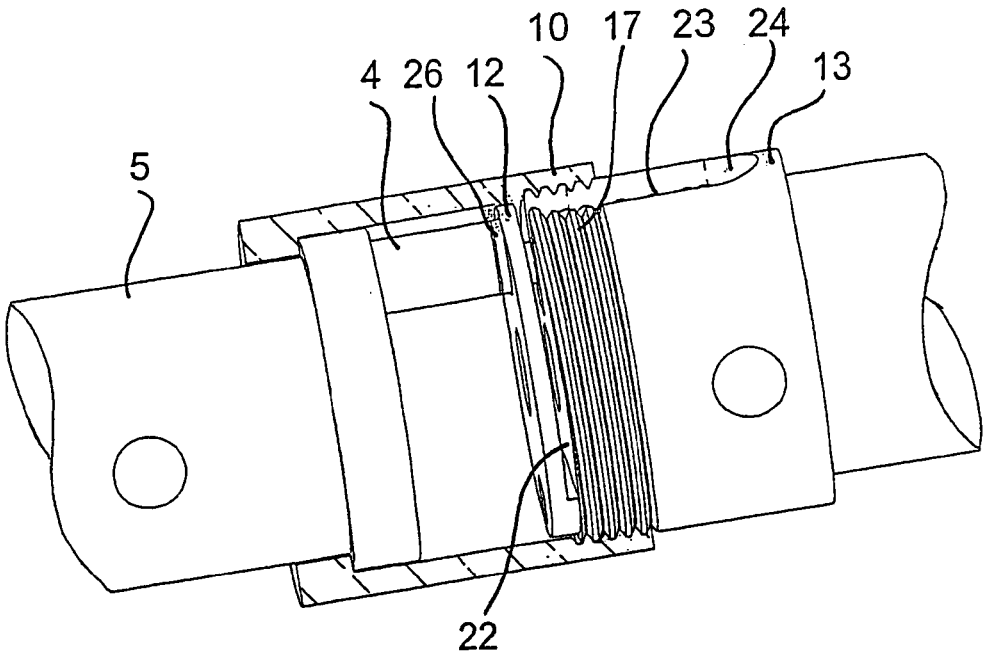
FIGS. 6 and 7 show a detail of the inside of the cable coupler of FIG. 5, with only the tightening ring being shown in section, and with the front insulation of the plug being omitted for greater clarity.
Figure 7:
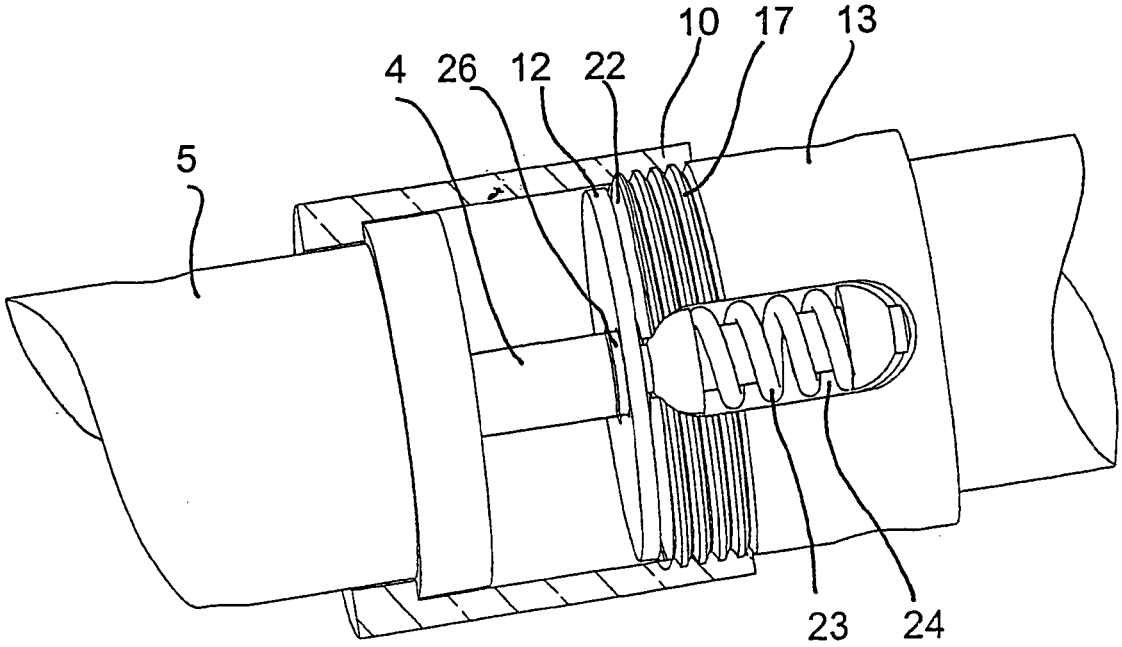

FIGS. 6 and 7 show in greater detail metal part 5 of the plug provided with its pin 4 and its tapped screw ring 10.

In this case, screw ring 10 is shown engaged with thread 17 on metal part 13 of connector 1.

As mentioned above, and for greater clarity in FIGS. 6 and 7 which show portions of connector 1 and plug 2 of the preceding figures without their cases, insulation 18 is also omitted from the connector.

These figures are intended more particularly to show the contact of the connector in the form of a flexible blade 12.

As shown in said FIGS. 6 and 7, the contact of connector 1 is constituted or formed in this example by a flexible blade 12 in the form of a circular segment constituted by a portion of the end surface of cylindrical metal part 13 which is provided with a cut 22 formed in its end, and in this example in a plane perpendicular to the longitudinal axis of part 13. Cut 22 is formed in a solid portion of part 13.

It will thus be understood that the contact of the connector in the form of a flexible blade 12 can thus flex under the action of pressure exerted by contact pin 4 of plug 2 in a direction parallel to the axis of part 13. In FIGS. 6 and 7, blade 12 is shown subject to little or no flexing.

As shown in particular in FIG. 6, the depth of cut 22 is greater than the radius of cylindrical part 13, while the zone where the pin comes into contact against blade 12 is at a distance from the bottom of cut 22.

In addition, it will be understood that the width of cut 22 is preferably selected to be no greater than the maximum deflection that is acceptable for the blade before it reaches its elastic limit, with it naturally being understood that under such conditions the blade cannot exceed said limit since, when maximally flexed, it comes into contact with the solid portion of part 13.

In addition, a compression spring 23 is provided in this example, being received in a housing 24 in part 13 against which it bears in order to press against blade 12 in such a manner as to contribute, if necessary, to blade 12 returning into position.

Because of spring 23, blade 12 can naturally return to an initial neutral position in which it is held by insulation 18 of the connector, but the insulation could be disposed in such a manner as to allow for possible flexing of blade 12 in an outward direction in order to increase the amplitude of the flexing stroke of blade 12.

Such a contact makes it possible to provide a connection element that is compact and inexpensive, while the all-metal one-piece design of part 13 including blade 12 makes it possible to ensure that the connection provides good reliability and little resistance to passing current.

Figure 2:
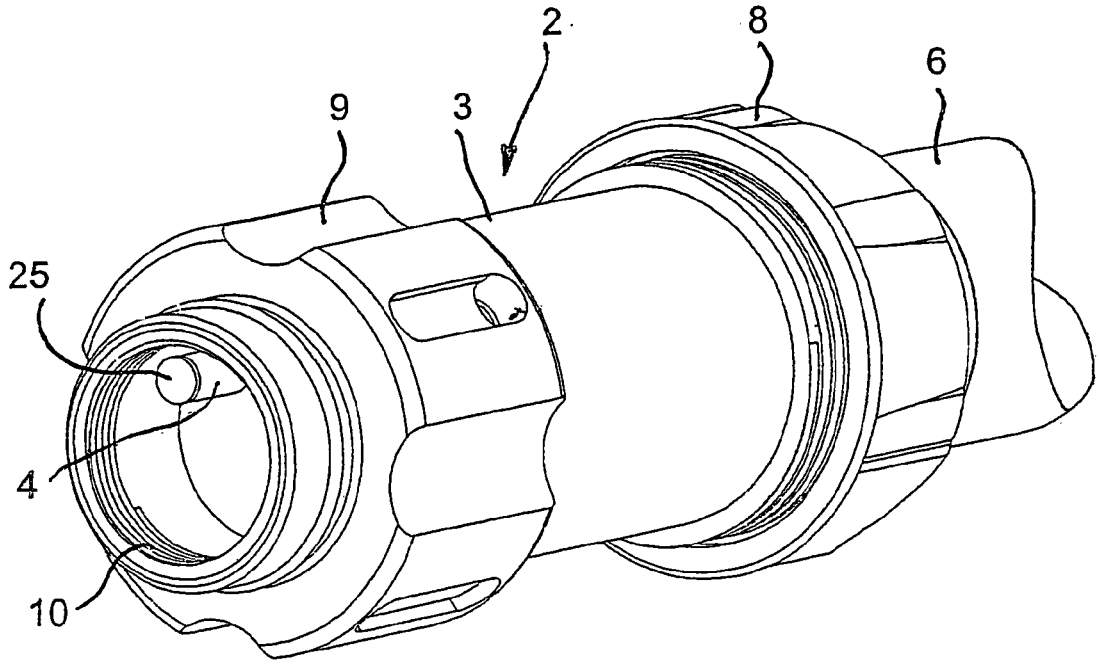

Other elements that are not described more particularly are also provided, such as O-rings for the plug, or indeed and advantageously, pellets of silver which are provided at the end of pin 4 as shown at 25 in FIG. 2, and/or on the zone of blade 12 where pin 4 comes to bear as shown at 26 in FIGS. 3, 6, and 7.

Nevertheless, as mentioned above, pin 4 of the plug may be of some other shape, circular or otherwise, and blade 12 may be offset in the connection element to couple with a centrally-located plug pin, or indeed the contact could include a plurality of blades made up of a plurality of circular or other segments with cuts that are optionally perpendicular to the axis of the conducive part.

Because of the contact as described and the elements used for fastening the coupling, the cable coupler also presents a major advantage against any risk of disconnection due to untimely traction on the cables, which could sometimes be a problem in the past when the cabled element was acted on directly by a spring.

The embodiment described is naturally given as an example of one possible application.

The invention relates to a particular electrical contact with elastic return, and also to connection elements fitted with at least one such contact.

Instead of relating to a connector for constituting a cable coupler for co-operating with a plug, the invention could naturally relate to a connector for constituting an appliance coupler for co-operating with an appliance inlet, or indeed a socket-inlet for co-operating with a plug.

In addition, although the invention is particularly well adapted to a single-pole connection, it is not restricted thereto.

What is claimed:

1. An electrical contact with elastic return, comprising:

a conductive part extending along a longitudinal axis and having a front end and a solid part, at least one space cut crosswise into said solid part, such that a portion of said front end and said at least one space forms at least one flexible blade for the electrical contact;

said at least one blade consisting of only a single blade; said single blade being structured and arranged to flex into said at least one space under pressure exerted by an opposing electrical contact;

said at least one space extends along a plane crosswise to the longitudinal axis of said conductive part to define a width of said space along said longitudinal axis and a depth of said space along said plane crosswise to said longitudinal axis; and said depth of said space being greater than said width of said space.

2. The electrical contact in accordance with claim 1, wherein:

said conductive part is cylindrical, and said at least one flexible blade comprises a circular or elliptical segment.

3. The electrical contact in accordance with claim 1, wherein:

said conductive part has a cylindrical shape extending along said longitudinal axis;

said depth of said space is greater than a radius of said cylindrical shape of said conductive part.

4. The electrical contact in accordance with claim 1, wherein:

said plane crosswise to the longitudinal axis of said conductive part is a plane perpendicular to the longitudinal axis of said conductive part.

5. The electrical contact in accordance with claim 1, wherein:

said width of said at least one space is no greater than a maximum acceptable deflection of said flexible blade, said acceptable deflection being less than an elastic limit of said flexible blade.

6. The electrical contact in accordance with claim 5, wherein:

said maximum deflection is a function of materials used in relation to a depth of said at least one space.

7. The electrical contact in accordance with claim 1, further comprising:

a compression spring arranged behind said at least one blade and positioned to bear against an end of a housing located in said conductive part.

8. The electrical contact in accordance with claim 7, wherein:

said compression spring is positioned to contribute to returning said at least one blade to an initial position.

9. The electrical contact in accordance with claim 1, further comprising:

a pellet of silver provided over at least a portion of said at least one flexible blade.

10. The electrical contact in accordance with claim 1, further comprising:

a material provided over at least a portion of said at least one flexible blade to improve passage of electric current between said contact and the opposing electrical contact.

11. A single-pole electrical connection element having an electrical contact in accordance with claim 1, wherein:

said opposing electrical contact structured and arranged to exert pressure on said at least one flexible blade in a direction parallel to an axis of said conductive part to flex said at least one blade into said space.

12. The single-pole electrical connection element in accordance with claim 11, wherein:

said opposing electrical contact is composed of a pin.

13. The single-pole electrical connection element in accordance with claim 12, wherein:

said pin is located in one of a plug or an appliance inlet.

14. The single-pole electrical connection element in accordance with claim 13, wherein:

said conductive part includes a threaded portion and said one of a plug or an appliance inlet comprises a screw ring structured and arranged to secure to said threaded portion of said conductor part.

15. The single-pole electrical connection element in accordance with claim 14, wherein:

said threaded portion terminates in a vicinity of said at least one space.

16. The single-pole electrical connection element in accordance with claim 11, wherein:

said single-pole electrical connection element comprises one of a socket-outlet or a connector.

17. The electrical contact in accordance with claim 1, wherein:

said space is entirely spaced from said front end of said conductive part.

18. The electrical contact in accordance with claim 1, wherein:

said space has the width prior to said pressure being exerted by opposing electrical contact; and said space is positioned relative to the blade such that, upon said pressure being exerted to the blade by the opposing electrical contact, the width decreases.

19. The electrical contact in accordance with claim 1, wherein:

said flexible blade has a non-threaded outer peripheral surface.

20. The electrical contact in accordance with claim 1, wherein:

said conductive part is structured and arranged for connection to an end of an electrical cable longitudinally spaced from said blade and said space.

21. An electrical contact with elastic return, comprising:

a cylindrical conductive part having a front end structured and arranged to face an end of a plug for making an electrical connection between the plug and said cylindrical conductive part; and said cylindrical conductive part having a longitudinal axis, a solid portion, and at least one slit extending crosswise to the longitudinal axis into the solid portion of the cylindrical conductive part to form at least one flexible blade coupled to a remaining portion of said cylindrical conductive part;

said at least one flexible blade comprising said front end of said conductive part;

said conductive part having a length extending along said longitudinal axis and a width perpendicular to said longitudinal axis, said length being greater than said width;

said at least one slit extending crosswise to the longitudinal axis of said conductive part defining a width of the slit along the longitudinal axis and a depth of the slit crosswise to the longitudinal axis;

said depth of said slit being greater than said width of said space.

22. The electrical contact in accordance with claim 21, further comprising:

an insulating layer arranged on said front end of said cylindrical conductive part, said insulating layer having an opening open to said front end, said opening adapted to receive a pin of a plug for flexing said at least one blade.

23. The electrical contact in accordance with claim 21, further comprising:

a housing formed in said cylindrical conductive part, and a compression spring located within said housing arranged to contact a surface of said front end adjacent said at least one slit.

24. A process of forming an electrical contact with elastic return according to claim 21, the process comprising:

cutting said at least one slit approximate an end of a cylindrical conductive part and crosswise to a longitudinal axis of the cylindrical conductive part to form said at least one flexible blade coupled to a remaining portion of the cylindrical conductive part.

25. The process in accordance with claim 24, further comprising:

forming a housing in the cylindrical conductive part adjacent the at least one slit; and positioning a compression spring in the housing to bias the at least one flexible blade away from the housing.

26. The process in accordance with claim 25, further comprising:

placing insulation over the at least one flexible blade;

the insulation including an opening open to the at least one flexible blade.

27. The process in accordance with claim 24, wherein:

said at least one flexible blade consists of only a single flexible blade.

28. The electrical contact in accordance with claim 21, wherein:

said slit is entirely spaced from said front end of said conductive part.

29. The electrical contact in accordance with claim 21, wherein:

said slit is positioned, relative to the blade, such that upon said pressure being exerted to the blade by an opposing electrical contact, the width decreases.

30. The electrical contact in accordance with claim 21, wherein:

said flexible blade has a non-threaded outer peripheral surface.

31. The electrical contact in accordance with claim 21,wherein:

said cylindrical conductive part is structured and arranged for connection to an end of an electrical cable longitudinally spaced from said blade and said slit.

32. A cable coupler comprising:

(a) a connector comprising an electrical contact with elastic return, said connector comprising:

a cylindrical conductive part having a front end and a solid part, the front end being structured and arranged to face an end of a plug for making an electrical connection between the plug and said cylindrical conductive part;

an insulating layer arranged on said front end of said cylindrical conductive part, said insulating layer having an opening open to said front end of said cylindrical conductive part;

said cylindrical conductive part having a longitudinal axis and at least one slit extending crosswise to said longitudinal axis into the solid part to form at least one flexible blade coupled to a remaining portion of said cylindrical conductive part;

said at least one flexible blade comprising said front end of said conductive part;

said conductive part having a length extending along said longitudinal axis and a width perpendicular to said longitudinal axis, said length being greater than said width;

said at least one slit extending crosswise to the longitudinal axis of said conductive part defining a width of the slit along the longitudinal axis and a depth of the slit crosswise to the longitudinal axis;

said depth of said slit being greater than said width of said space; and (b) a plug adapted to be coupled to said connector, said plug comprising an electrical contact structured and arranged to pass through said opening of said insulating layer of said connector and to contact and flex said front end of said cylindrical conductive part of said connector.

33. The cable coupler in accordance with claim 32, further comprising:

a screw ring couplable to said cylindrical conductive part of said connector, wherein said electrical contact of said plug is structured and arranged to exert pressure on said front end of said cylindrical conductive part when said screw ring is secured to said cylindrical conductive part of said connector.

34. The cable coupler in accordance with claim 32, wherein:

said opening in said insulating layer is off-center relative to said longitudinal axis of said cylindrical conductive part of the connector.

* * * * *